US009345344B1

(12) United States Patent
Arabi-Beam et al.

(10) Patent No.: US 9,345,344 B1
(45) Date of Patent: May 24, 2016

(54) TRANSPORTABLE DISPLAY HOLDER FOR ARTICLES STORED THEREIN

(71) Applicants: Samira Arabi-Beam, Dayton, OH (US); Brad Beam, Dayton, OH (US)

(72) Inventors: Samira Arabi-Beam, Dayton, OH (US); Brad Beam, Dayton, OH (US)

( * ) Notice: Subject to any disclaimer, the term of this patent is extended or adjusted under 35 U.S.C. 154(b) by 0 days.

(21) Appl. No.: 14/590,773

(22) Filed: Jan. 6, 2015

(51) Int. Cl.

| | |
|---|---|
| ***A47F 5/02*** | (2006.01) |
| ***A47F 5/10*** | (2006.01) |
| ***A47F 7/28*** | (2006.01) |
| ***A47F 5/00*** | (2006.01) |
| *A47F 7/02* | (2006.01) |

(52) U.S. Cl.
CPC ..... *A47F 5/108* (2013.01); *A47F 5/0018* (2013.01); *A47F 7/28* (2013.01); *A47F 5/02* (2013.01); *A47F 7/022* (2013.01)

(58) Field of Classification Search
CPC ..... A47F 5/108; A47F 5/0018; A47F 5/02; A47F 7/022; A47F 7/28
USPC ..... 211/77, 78, 129.1, 131.1; 220/23.83, 220/23.86, 23.88, 506; 206/501, 514
See application file for complete search history.

(56) References Cited

U.S. PATENT DOCUMENTS 197,931 A * 12/1877 Haight ..... A47B 11/00 108/94
353,554 A * 11/1886 Godfrey ..... A47F 5/0037 211/77
417,082 A * 12/1889 Pichereau ..... B43L 25/10 15/257.073
551,059 A * 12/1895 Stone ..... A47L 15/50 220/488
1,405,495 A * 2/1922 Cook ..... A47F 7/163 108/28
2,117,459 A * 5/1938 Stanton ..... A47K 1/09 131/256
D120,770 S 5/1940 Younghusband
2,457,875 A * 1/1949 Day ..... A45C 11/02 206/8
D156,794 S * 1/1950 Wingo ..... 131/240.1
2,953,257 A * 9/1960 McNeill ..... A47F 7/021 211/131.1
3,214,029 A * 10/1965 Jack ..... G11B 23/03 211/163
3,425,564 A * 2/1969 Allsop ..... A47F 7/08 12/120.5
3,526,335 A * 9/1970 Swett ..... A47G 19/2255 215/10
3,543,943 A * 12/1970 Joy ..... A47F 5/05 211/131.1
3,848,943 A * 11/1974 Geesaman ..... A47B 81/04 206/373
3,854,582 A * 12/1974 Martinelli ..... B65D 21/022 206/508
3,912,085 A * 10/1975 Cooke ..... A47B 57/26 108/27
4,026,417 A * 5/1977 Streim ..... A47F 7/024 108/94
D252,828 S 9/1979 Davidson
4,194,697 A * 3/1980 Lembeck ..... A47J 43/06 222/352
4,311,237 A * 1/1982 Hayes ..... A47G 23/08 206/203

(Continued)

*Primary Examiner* — Joshua J Michener
*Assistant Examiner* — Devin Barnett
(74) *Attorney, Agent, or Firm* — R. William Graham

(57) ABSTRACT

A display stand holder, particularly for nail polishes, includes a central storage housing for containing an article therein and a first peripheral storage compartment surrounding the central storage housing having an outer translucent wall to permit visual inspection of an article stored therein and the display stand holder is rotatable.

26 Claims, 3 Drawing Sheets

(56) References Cited

U.S. PATENT DOCUMENTS 4,453,326 A * 6/1984 Hoffman ..... B42F 21/02 211/129.1
4,534,474 A * 8/1985 Ng ..... B25H 3/04 206/501
4,549,664 A * 10/1985 Gowan ..... B25H 3/06 206/508
4,760,930 A * 8/1988 Fox ..... A47B 96/027 211/153
4,968,253 A 11/1990 Thomas
4,978,023 A * 12/1990 Behlmann ..... A47J 41/00 206/501
5,379,885 A * 1/1995 Chen ..... B25H 3/06 206/216
5,511,666 A * 4/1996 Grip ..... B65D 85/00 206/315.9
5,562,518 A * 10/1996 Estrada ..... A63H 37/00 220/8
5,641,080 A * 6/1997 Humphrey ..... A47B 49/004 211/163
5,669,494 A * 9/1997 Geffen ..... G11B 33/045 206/309
5,813,741 A * 9/1998 Fish ..... F25D 25/024 108/108
D418,706 S * 1/2000 Robishaw ..... D6/534
6,234,346 B1 * 5/2001 Castleberry ..... G06F 11/54 211/129.1
6,439,406 B1 * 8/2002 Duhon ..... A47B 49/00 211/131.1
6,457,593 B1 * 10/2002 Hsu ..... A47F 7/0028 211/163
D475,413 S * 6/2003 Castleberry ..... D20/4
6,585,119 B2 * 7/2003 Palder ..... A47F 7/28 211/163
D478,756 S * 8/2003 Hood ..... D6/534
6,631,804 B2 * 10/2003 Wong ..... A47F 5/02 206/501
6,666,329 B1 * 12/2003 Charbonneau ..... A61J 7/0046 206/218
6,729,472 B2 * 5/2004 Stucke ..... A47G 19/23 206/515
D490,848 S * 6/2004 Pope ..... D19/107
6,755,380 B2 6/2004 Pace
7,395,939 B2 * 7/2008 Morris ..... A47K 1/09 182/70
7,617,927 B1 * 11/2009 Smith, Jr. ..... A45D 44/18 206/18
7,980,387 B2 * 7/2011 Allen ..... A45C 7/0031 206/214
7,987,321 B1 * 7/2011 Agarwal ..... G06F 12/0811 711/141
D661,147 S * 6/2012 Tran ..... D6/528
8,210,373 B2 * 7/2012 Liao ..... A47B 87/0246 211/131.1
8,596,222 B1 * 12/2013 Campbell ..... A01K 1/0236 119/474
8,690,741 B2 * 4/2014 Ross ..... A63B 21/075 482/148
D708,257 S * 7/2014 Camarata ..... D19/77
8,915,391 B2 * 12/2014 Radow ..... A47G 19/00 108/139
2002/0000417 A1 * 1/2002 Kidd ..... A47F 7/021 211/85.1
2003/0196970 A1 * 10/2003 Jiang ..... A47B 49/00 211/40
2006/0090917 A1 * 5/2006 Lowe ..... H02G 9/10 174/50
2006/0169653 A1 * 8/2006 Palder ..... A47F 5/02 211/49.1
2006/0278592 A1 * 12/2006 Zipeto ..... A47B 61/04 211/78
2007/0012693 A1 * 1/2007 Kummer ..... B65D 43/0231 220/4.27
2007/0045206 A1 * 3/2007 Tiemann ..... A47B 49/00 211/77
2007/0062892 A1 * 3/2007 Donnellan ..... A47B 49/00 211/74
2008/0061065 A1 * 3/2008 Aronson ..... B65D 1/36 220/556
2009/0014399 A1 * 1/2009 Bott ..... A47K 1/09 211/85.12
2009/0057252 A1 * 3/2009 Eckenrode ..... A47G 23/08 211/131.1
2010/0108693 A1 * 5/2010 Zhang ..... B65D 81/3869 220/592.2
2010/0288659 A1 * 11/2010 Dang ..... A47K 1/09 206/277
2011/0031199 A1 * 2/2011 Tobey ..... A61J 1/16 211/131.1
2011/0174763 A1 * 7/2011 Kennedy ..... A47G 19/2255 215/377
2012/0041589 A1 2/2012 Nguyen
2012/0318761 A1 * 12/2012 Volk ..... A47K 1/09 211/65
2014/0014603 A1 * 1/2014 Thompson ..... A47F 5/02 211/78

* cited by examiner 10
72
74
50
40
16
12

18
68
42
10
70
52
53
29
26
28

10
53
26

20
12
15

4A
4A
12
15
18
68
74

72

12
20
18
10
14
42
52
26

FIG. 5
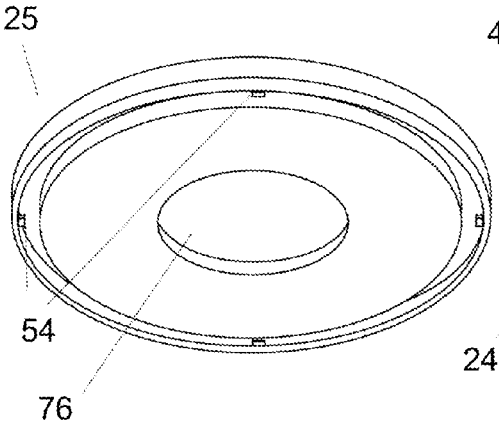
FIG. 6
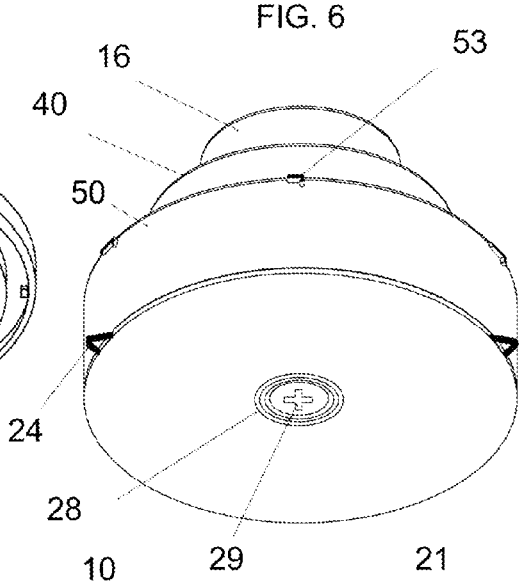
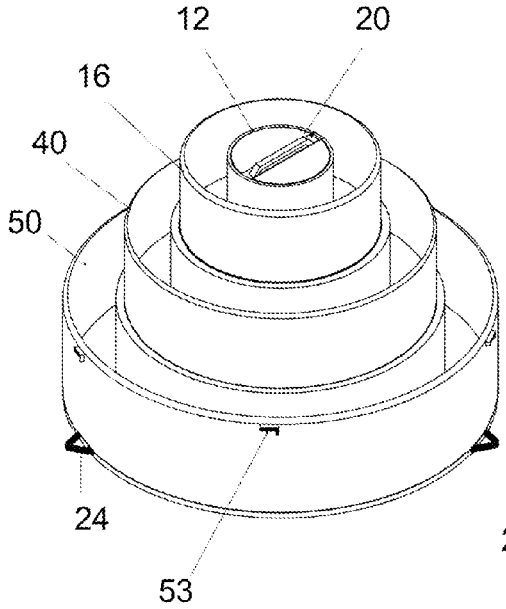
FIG. 7
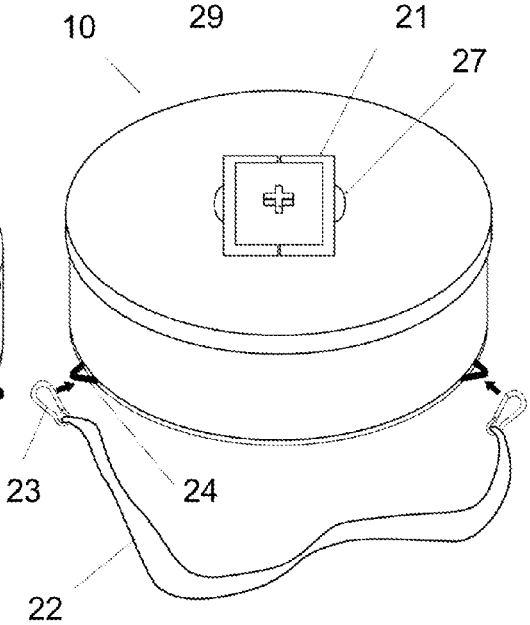
FIG. 8

TRANSPORTABLE DISPLAY HOLDER FOR ARTICLES STORED THEREIN

FIELD OF INVENTION

The present invention relates to a transportable display holder for articles stored therein. More particularly, the invention relates to a transportable nail polish display for nail polish bottles.

BACKGROUND OF THE INVENTION

The cosmetic industry has grown to a multibillion dollar per year business. The cosmetic industry has created numerous available color shades of nail polish.

Conventionally, these polishes are displayed in racks in commercial settings which can take a large space and large foot print. Once purchased, the polishes are typically kept in a disorganized manner, such as a purse and are not easily sorted thereafter.

The present invention provides a nail polish color transportable display stand which provides a desirable use for commercial as well as consumer personal usage. The display stand of the present invention can display numerous different nail polish shades within a small cylindrical housing having minimal foot print.

DESCRIPTION OF THE PRIOR ART

Many types of display stands are known in the prior art. These include vertical, horizontal and cylindrical types of display stands. Some prior art provide for vertical ascending shelves for storing articles. The art is relatively crowded with respect to various types of display stands, and it can be appreciated that there is a continuing need for and interest in improvements to such display stand holder, and in this respect, the present invention addresses this need and interest.

SUMMARY OF THE INVENTION

It is an object to improve polish displays.

It is a further object to improve nail polish display stand holders.

It is another object to provide an improved polish display stand holder.

It is a further object of the present invention to provide a new and improved nail polish color display stand holder which is of a durable and reliable construction.

Still another object of the present invention is to provide a new and improved nail polish color display stand holder which allows a number of nail polish colors to be displayed in a small footprint.

Another object of the present invention is to provide a new and improved nail polish color display stand holder which utilizes a rotatable housing having a hollow interior with an interior side wall forming a plurality of vertically ascending shelves, of differing diameter for displaying numerous nail polishes colors in an a readily accessible manner.

The present invention provides an embodiment directed to an improved nail polish color display stand holder. The embodiment of the present invention is illustrated in the drawings. The invention includes a central storage housing for containing an article, such as nail polish remover and/or cotton balls, therein and an adjacent peripheral storage compartment surrounding the central storage housing having an outer translucent wall to contain and to permit visual inspection of an article, such as nail polish, stored therein. The adjacent peripheral storage compartment has a cross-sectional width slight larger than the article (e.g., nail polish) to be stored therein to restrict a degree of freedom of movement of the article.

The display stand holder has a handle connected to at least one of the central storage housing and the adjacent peripheral storage compartment for enabling transport of said display. The display stand holder includes a lid covering at least one of the central storage housing and the adjacent peripheral storage compartment and is removably connected to at least one of the central storage housing and the adjacent peripheral storage compartment.

The central storage housing includes a base support structure rotatably mounted thereto and has a lid engaging surface. The lid has a complementary base engaging surface for engaging the lid engaging surface when operably disposed therebeneath such that when so disposed and engaged, the base support structure is rotatable with respect to the lid. The display stand holder can include one or more outer peripheral storage compartment surrounding the central storage housing and the adjacent peripheral storage compartment and having an outer translucent wall to contain and to permit visual inspection of an article stored therein.

The adjacent peripheral storage compartment and one or more outer peripheral storage compartment are movably connected in a telescoping manner such that the adjacent peripheral storage compartment can be fixed in a collapsed mode wherein the central storage housing, adjacent storage compartment and one or more outer peripheral storage compartments are contained within common planes and extended mode wherein the adjacent storage compartment can be fixably retained outside of a common plane. The one or more outer peripheral storage compartment can include lid retaining detents and the lid can include complementary outer peripheral storage compartment retaining detents which when the lid is placed over and in contact with the outer peripheral storage compartment in the collapsed mode, the lid can be rotated such the detents interconnect to secure the lid to the outer peripheral storage compartment containing the central storage housing and storage compartments in the collapsed mode.

A plurality of various like articles, such as nail polishes of varying color can be displayed in the peripheral storage compartments. The display stand holder allows a number of different color shades to be displayed in a small footprint and permits view thereof by simple rotation of the display stand holder.

There can be one or more inserts which seat transversely in the storage compartments and serve to prevent a degree of freedom of movement of articles stored therein. The inserts can be frictionally retained within the compartments.

There has thus been outlined features of the invention in the detailed description that follows so that the present contribution to the art may be better appreciated. Additional features of the invention that will be described hereinafter and which will form the subject matter of the claims appended hereto.

These together with other objects of the invention, along with the various features of novelty which characterize the invention. Reference should be made to the accompanying drawings and descriptive matter in which there are illustrated preferred embodiments of the invention.

BRIEF DESCRIPTION OF THE DRAWINGS

FIG. 5 is a view of a bottom side of the lid of the present invention.

FIG. 6 is an erected bottom perspective view of the display stand holder of the invention.

FIG. 7 is an erected top perspective view of the display stand holder of the invention.

FIG. 8 is a collapsed top perspective view of the display stand holder of the invention.

DESCRIPTION OF THE PREFERRED EMBODIMENTS

Figures 1, 1A, 2, 3, 3A, 4, 4A:
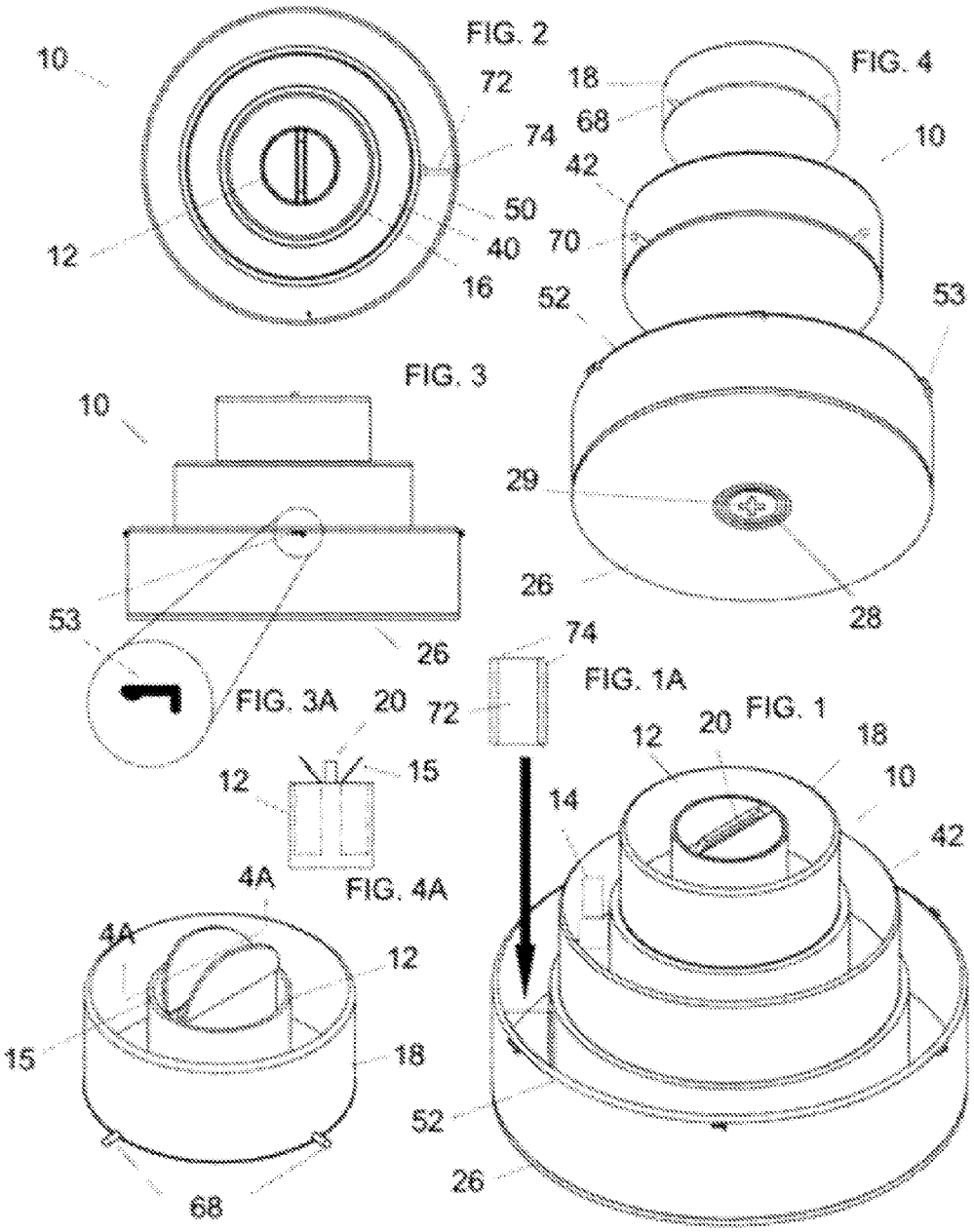
FIG. 1 is a perspective view illustrating a nail polish color display stand holder according to an erect mode of the present invention.
FIG. 1A illustrates an insert of the invention.
FIG. 2 illustrates a top plan view of a nail polish display stand holder according to the present invention.
FIG. 3 illustrates a side view of a nail polish display stand holder according to the present invention.
FIG. 3A is a blow up of a portion of FIG. 3.
FIG. 4 is a perspective exploded view of components of the invention.
FIG. 4A is a partial cross sectional view, taken along line 4A-4A of FIG. 4.
Figure 9:
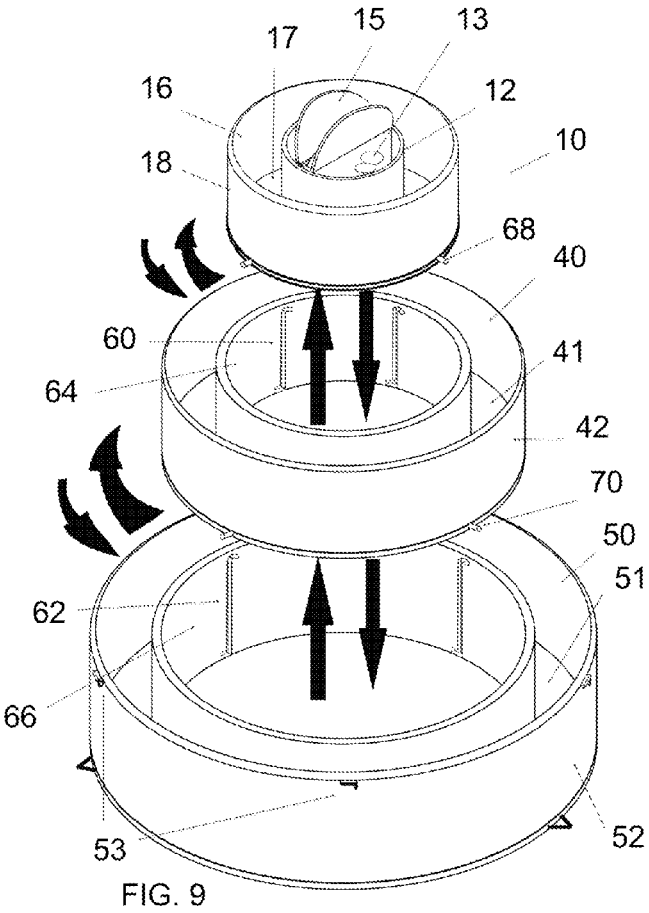
FIG. 9 is an exploded perspective view of parts of the invention illustrating directional arrows for erecting and collapsing and securing each part into a position.
Figure 10:
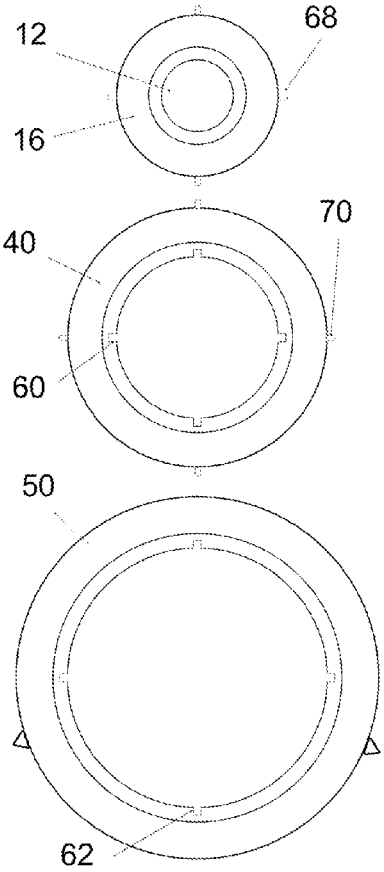
FIG. 10 illustrates mid sectional views of parts of the invention shown in FIG. 9.

Referring now to the drawings, a new and improved nail polish display stand holder embodying the principles and concepts of the present invention and generally designated by the reference numeral 10 will be described. The stand holder 10 of the invention includes a central storage housing 12 for containing an article 13, such as nail polish remover and/or cotton balls, therein. The display stand holder 10 has a handle 20 which is connected to the central storage housing 12. A pair of hinged covers 15 can be provided on top of the storage housing 12. An adjacent peripheral storage compartment 16 surrounds the central storage housing 12 and has a floor 17 and an outer translucent wall 18 to contain and to permit visual inspection of an article 14, such as nail polish, stored therein. The adjacent peripheral storage compartment 16 has a cross-sectional width W slight larger than the article 14 (e.g., nail polish) to be stored therein to restrict a degree of freedom of movement of the article 14.

A removable strap 22 can also be connected to the holder 10 by way of clips 23 on the strap 22 and eyelets 24 on the holder 10. Lid 25 can also include hinged handles 21 which can be recessed into complementary recessed surfaces 27 in lid 25 which also provide access for lifting handles 21.

The stand holder 10 includes a base support structure 26 and a lid engaging surface 28 therein. In this regard, the base support structure 26 includes a female socket 29 with a bearing mechanism 31 connected to display stand holder 10. The lid 25 can have a complementary base engaging surface 30 with male member 33 for engaging the lid engaging surface 28 when operably disposed beneath base support structure 26 such that when so disposed and engaged, the base support structure 26 is rotatable to the lid 25.

The display stand holder 10 can include outer peripheral storage compartments 40 and 50, respectively, surrounding the central storage housing 12 and peripheral storage compartment 16. Each of the outer peripheral storage compartments 40 and 50 has a floor 41 and 51, respectively, and an outer translucent wall 42 and 52, respectively, to contain and to permit visual inspection of an article 14 stored therein. The walls 18, 42 and 52 can preferably be of a height to fully contain articles 14 therein to prevent visual obstruction of an upwardly disposed article 14. The display lid 25 is characterized to be removably connected about the central storage housing 12 and compartments 16, 40 and 50. The display lid 25 is characterized to be removably connected to outer peripheral storage compartment 50 and covers central storage housing 12 and peripheral storage compartments 16, 40 and 50 by way of a detent mechanism such as a snap fit or other suitable mechanical connection or the like which is sufficiently strong to enable securely lifting of the stand holder 10 with articles 14 therein. In the shown embodiment, the outer peripheral storage compartment 50 can include lid retaining detents 53 and the lid 25 includes complementary outer peripheral storage compartment retaining detents 54 which when the lid 25 is placed over and in contact with the outer peripheral storage compartment 50 in the collapsed mode as seen in FIG. 8, the lid 25 can be rotated such the detents 52 and 54 interconnect to secure the lid 25 to the outer peripheral storage compartment 50 containing the central storage housing 12 and storage compartments 16, 40 and 50 in the collapsed mode.

Figure 11:
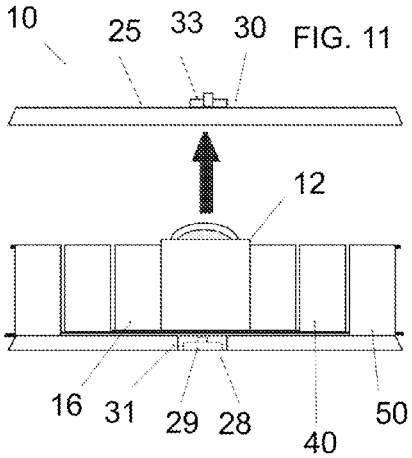
FIG. 11 illustrates a sectional view of a lid and parts of the invention in a separated state.

The adjacent peripheral storage compartment 16 (with central storage housing 12 therein) and outer peripheral storage compartments 40 and 50 are movably connected in a telescoping manner such that the peripheral storage compartments 16, 40, 50 can be fixed in a collapsed mode wherein the adjacent storage compartment 16 with central storage housing 12 therein, and outer peripheral storage compartments 40 and 50 are contained within common planes as seen in FIGS. 8 and 11 and an extended mode wherein the adjacent storage compartment 16 with central storage housing 12 therein, compartment 40 and compartment 50 can be fixably retained outside of common planes as seen in FIGS. 1, 3, 7 and 12. This can be performed by employing a Z-shaped tracks 60 and 62, for example, in inner wall surfaces 64 and 66 of compartments 40 and 50, respectively, which receive snap-in position retaining pins 68 and 70 extending from outer wall surfaces 18 and 42 of compartments 16 and 40, respectively.

Figure 12:
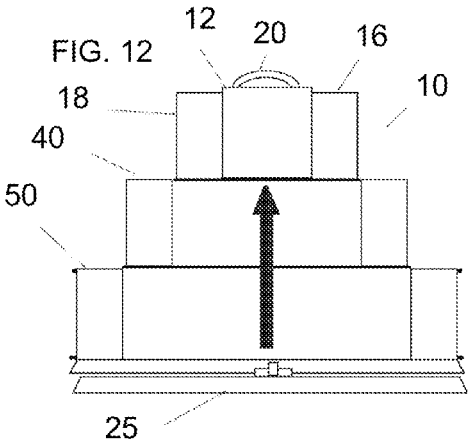
FIG. 12 illustrates a sectional view of a lid disposed beneath parts of the invention in an erected state.

It is contemplated that handles 21 or 22 can be used enabling secure transport of the display stand holder 10. A plurality of various like articles 14, such as nail polishes of varying color, can be displayed in the peripheral storage compartments 16, 40 and 50. The display stand holder 10 allows a number of different color shades to be displayed in a small footprint and permits view thereof by simple rotation of the display stand holder 10 using handle 20 when in mode as seen in FIG. 12. Thus, there is created vertically ascending compartments 16 (with storage housing 12 therein), 40 and 50. Each compartment 16, 40 and 50 can include a plurality of the articles 14, such as different nail polish colors which can be easily accessed from one vantage point of the user. To extend the compartments 16, 40 and 50, one gasps the handle 20, rotates it clockwise and pulls upward until it locks in a stop of the track 60, 62. To collapse the containers, one grasps the handle 20 and rotates counterclockwise until the compartments 16, 40 and 50 drop down and lock in a closed position in the stop of the track 60, 62 at the other end.

There can be one or more inserts 72 which seat transversely in the peripheral storage compartments 16, 40 and 50 and serve to prevent a degree of freedom of movement of articles 14 stored therein. Multiple inserts 72 can be used and frictionally retained within the compartments by way of foot pads 74 at each end of the insert 72.

The instant invention is ideally suited as an innovative nail care product that has been designed to organize and display bottles of nail polish. The product can be molded plastic including multiple tier containers with transparent walls, through which the color and type of nail polish can be observed. The compartments 16, 40 and 50 have a track mechanism that allows each nail polish bottle to be lifted and supported, displaying all the bottles stored in the product and providing easy access for use. After use, the holder 10 can be collapsed and covered with the carrying lid 25, allowing all the bottles to be stored in a very compact manner. The handle 20 does is configured to fit within an underside recess surface 76 within lid 25.

Currently, most home or salon nail polish is stacked along a shelf or placed in a basket. The bottles are not always visible from the side so the color and amount of polish is not easily identified. The user has to pull each bottle up, look at it, and if it is not the correct color, replace it and continue the search. If they are on a shelf, they can be knocked off as the ones in the back rows are moved to determine with color within. If they fall to floor, the bottle can break or the brush handle can crack, ruining the seal on the bottle and allowing the contents to dry out.

The instant invention resolves most of these problems by providing concentric, tall walled compartments, through which the user can see each bottle stored in the product. The layers can be lifted and locked to display all containers in concentric relation, in which the bottles of polish are stored. The user can easily see the color they wish to use and can easily access it by gripping a brush holder of the nail polish bottle and removing the bottle from storage. After use, the product can be collapsed, providing compact storage with multiple concentric rings of space for the bottles. In the center, there can be one or more cavities with protective covers that can easily be accessed. The user can store nail polish remover, cotton balls, and other nail polishing paraphernalia in these cavities, which also collapse into the bottom layer when not being used.

The holder can be equipped with numerous compartments, larger or smaller in diameter as desired. The holder can be injection molded from durable clear polycarbonate plastic and which is highly resistant to household chemicals and is suitable for this type of application. An upper edge of each of the containers can be aluminized using the vacuum vapor deposition process.

The interior storage cavities and operating handle can be injection molded using polypropylene plastic. This plastic is also very durable, is highly resistant to household chemicals, and is often used in this type of application. The storage insert can be supplied in almost any vibrant color, so a distinctive color may be chosen to enhance the product which can dramatically improve the market adoption of the product. The round exterior of the internal storage cavities is slipped inside the smallest container and can be adhesively bonded into place. The protective doors are also injection molded from polypropylene plastic and arc snapped into the mating molded hinge sections on the storage cavity molding. A finger opening is provided to allow easy access and use of the doors. A carrying lid can also be injection molded using polypropylene plastic.

Moveable inserts 72 can be molded from the polypropylene plastic and supplied with the holder for use when the container is not filled entirely with polish bottles to restrain lateral movement of the bottles 14 and prevent them from tipping over.

The invention is designed to be aesthetic and effective in the application. The case of manufacture and the inexpensive components provide good marketability for the manufacturer. The user benefits from improved organization and display of each bottle of polish and safe and compact storage when the polish is not being used, which should provide considerable market interest in the product.

The invention is illustrated in the drawings of the essential points as explained in the documentation. The product is designed to hold various shapes of 0.5 ounce bottle of polish, with the most common shape being a flattened cylinder with a slightly rounded upper section. Almost all are topped with a cap that serves as a handle and has an attached brush that reaches to near the bottom of the bottle.

The bottles go around the periphery of the each compartment 16, 40 and 50 with bottle top located just below the upper edge of wall 18, 42 and 52. This allows the user to easily grip the bottle cap and lift the bottle out of the storage display holder.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Also, it is to be understood that the phraseology and terminology employed herein are for description and should not be regarded as limiting. As such, those skilled in the art will appreciate that the conception, upon which this disclosure is based, may readily be used as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A display stand holder for storing cosmetic items, the display stand holder includes:

a base having an open top and a floor at the bottom of the base, an outer cylindrical wall extending upwardly from the floor, an inner wall extending upwardly from the floor, wherein a compartment for storing items is defined between the outer wall and the inner wall; an inner storage compartment for storing items, the inner storage compartment having a floor with an outer cylindrical wall depending upwardly therefrom, the inner storage compartment being operably configured to be slidably received within the base and slidably and telescopically movable from a first storage position wherein the inner storage compartment is nested with the base to a second expanded position, wherein the inner storage compartment is supported above the base in a tiered manner; wherein a removable lid is configured to cover the top of the base and the inner storage compartment in the first storage position; wherein the lid is configured to be attached beneath the base with the base being rotatable with respect to the lid in the second expanded position.

2. The display stand holder of claim 1, wherein said inner storage compartment has a cross-sectional width slight larger than the article to be stored therein to restrict a degree of freedom of movement of the article.

3. The display stand holder of claim 1, which includes a central storage housing, wherein a handle is connected to at least one of said central storage housing and said inner storage compartment.

4. The display stand holder of claim 3, wherein the lid covers at least one of said central storage housing, said inner storage compartment, and said base.

5. The display stand holder of claim 4, wherein said lid is connected to at least one of said central storage housing, said inner storage compartment, and said base and includes a handle for enabling transport of said display.

6. The display stand holder of claim 4, wherein said lid is removably connected to at least one of said central storage housing, said inner storage compartment, and said base and includes a handle for enabling transport of said display.

7. The display stand holder of claim 4, wherein said lid is removably connected about said central storage member.

8. The display stand holder of claim 4, wherein said base has a rotatable bearing mechanism mounted thereto with a lid engaging surface and said lid has a complementary base engaging surface for engaging said lid engaging surface when operably disposed therebeneath such that when so disposed and engaged, said base is rotatable to said lid.

9. The display stand holder of claim 1, wherein the items are polish.

10. The display stand holder of claim 1, which further includes an adjacent peripheral storage compartment surrounding said central storage housing and said adjacent peripheral storage compartment has an outer translucent wall to permit visual inspection of an article stored therein.

11. The display stand holder of claim 1, which includes a removable insert which frictionally seats transversely in said inner storage compartment to prevent a degree of freedom of movement of the items when stored therein.

12. The display stand holder of claim 8, wherein said bearing mechanism is disposed about said lid engaging surface.

13. The display stand holder of claim 4, wherein said lid and said base are connected by a detent mechanism.

14. The display stand holder of claim 1, wherein said lid and said base are connected by a detent mechanism.

15. The display stand holder of claim 10, wherein said base and said inner storage compartment are connected in a telescoping manner and are securable in and out of common planes.

16. The display stand holder of claim 10, which includes a handle connected to at least one of said central storage housing, said adjacent peripheral storage compartment and said base.

17. A display stand holder for storing cosmetic items, the display stand holder includes:

a central storage housing for containing an article therein, the central storage housing having a top and a floor with an outer cylindrical wall; and an adjacent peripheral storage compartment surrounding said central storage housing, the peripheral storage compartment having an open top and a floor with an outer cylindrical wall depending upwardly therefrom, wherein the peripheral storage compartment is configured to store articles therein; and a lid removably connected to said central storage housing and said peripheral storage compartment to cover open tops of the central storage housing and the peripheral storage compartment and the articles stored therein, wherein the lid has a male member protruding upwardly from the lid; and said display stand holder includes a base support structure having a bearing mechanism rotatably mounted to a bottom surface of the base; wherein the bearing mechanism comprises a female socket corresponding to said male member; wherein the lid is configured to be removed from the tops of the central storage housing and the peripheral storage compartment and attached beneath the base support structure such that said base support structure is rotatable to said lid.

18. The display stand holder of claim 17, wherein said peripheral storage compartment has an outer translucent wall to contain and to permit visual inspection of an article stored therein.

19. The display stand holder of claim 17, wherein said peripheral storage compartment has a cross-sectional width slight larger than the article to be stored therein to restrict a degree of freedom of movement of the article.

20. The display stand holder of claim 17, which includes a handle connected to at least one of said central storage housing and said peripheral storage compartment.

21. The display stand holder of claim 17, wherein said lid covers at least one of said central storage housing and said peripheral storage compartment.

22. The display stand holder of claim 17, wherein the article is polish.

23. The display of claim 17, which further includes a removable insert which frictionally seats transversely in said peripheral storage compartment to prevent a degree of freedom of movement of the article when stored therein.

24. The display stand holder of claim 18, wherein said lid and said peripheral storage compartment are connected by a detent mechanism.

25. The display stand holder of claim 18, wherein said base support structure and said adjacent peripheral storage compartment are connected in a telescoping manner and are securable in and out of common planes.

26. The display stand holder of claim 18, which includes a handle connected to at least one of said central storage housing, said adjacent peripheral storage compartment and said base support structure.

* * * * *